United States Patent [19]

Sparr, Sr.

[11] Patent Number: 4,817,823

[45] Date of Patent: Apr. 4, 1989

[54] SPLIT CLIP FOR FOLDED COLLAPSIBLE TUBE

[76] Inventor: Anders V. Sparr, Sr., P.O. Box 48, Waupun, Wis. 53963

[21] Appl. No.: 111,278

[22] Filed: Oct. 22, 1987

[51] Int. Cl.[4] ..... B65D 37/00

[52] U.S. Cl. ..... 222/103; 24/546; 24/563

[58] Field of Search ..... 222/99, 100, 103, 92, 222/93, 215; 24/545, 546, 563, 570, 571

[56] References Cited

U.S. PATENT DOCUMENTS

| | | | |
|---|---|---|---|
| 607,530 | 7/1898 | Taylor | 222/99 |
| 1,949,607 | 3/1934 | Harrold | 222/103 X |
| 2,021,609 | 11/1935 | Pippert | 24/563 X |
| 2,161,516 | 6/1939 | Jung | 222/99 |
| 2,390,314 | 12/1945 | Massey | 222/103 |
| 2,656,069 | 10/1953 | Fogarty | 222/103 |
| 3,211,341 | 10/1965 | Bailey | 222/103 |
| 3,446,468 | 5/1969 | Sakwa | 248/108 |
| 4,159,787 | 7/1979 | Wright | 222/103 |
| 4,576,314 | 3/1986 | Elias | 222/97 |
| 4,729,496 | 3/1988 | Davidson | 222/215 |

FOREIGN PATENT DOCUMENTS

| | | | |
|---|---|---|---|
| 2149801 | 7/1982 | Fed. Rep. of Germany | 222/99 |

*Primary Examiner*—Kevin P. Shaver

*Attorney, Agent, or Firm*—Fleit, Jacobson, Cohn & Price

[57] ABSTRACT

A longitudinally slotted sleeve constructed of stiff, but slightly resilient material is provided with one end of the longitudinal slot being outwardly flared. The one end of the sleeve may be longitudinally advanced into engagement with a flattened reversely folded flattened portion of a collapsible tube in order to prevent fluent material within the non-flattened end of the tube from returning to the flattened end portion thereof when the non-flattened end is squeezed to express additional fluent material therefrom.

5 Claims, 1 Drawing Sheet

SPLIT CLIP FOR FOLDED COLLAPSIBLE TUBE

BACKGROUND OF THE INVENTION

1. Field of the Invention

This invention relates to a longitudinally split sleeve constructed of stiff, but slightly resilient material. The sleeve is provided for longitudinal displacement into position clampingly engaging a reversely folded portion of a flattened end portion of a partially empty collapsible tube. The clip prevents fluent material within the non-flattened end portion of the tube from passing into the flattened end portion of the tube as the non-flattened end portion is squeezed in order to further express fluent material from the tube.

2. Description of Related Art

Various different structures including some of the structural features of the instant invention heretofore have been provided for expressing fluent material from collapsible tubes. Examples of these structures are disclosed in U.S. Pat. Nos. 1,949,607, 2,390,314, 2,656,069, 3,211,341, 3,446,468, 4,159,787 and 4,576,314.

However, these previously known structures are not as readily usable, as simplified in construction or as inexpensive to produce as the clip of the instant invention.

SUMMARY OF THE INVENTION

The clip of the instant invention incorporates a longitudinally split sleeve constructed of stiff, but somewhat resilient material. The length of the sleeve is at least slightly greater than the width of a flattened end portion of a collapsible tube with which the sleeve is to be used and after the closed end portion of a collapsible tube has been flattened to express fluent material within the tube from the flattened area thereof, the flattened end portion folded back upon itself along a fold line extending transversely of the tube and closely adjacent the non-flattened end portion of the tube. Thereafter, the sleeve is engaged over the folded portion of the tube in a manner such that transverse zones of the flattened area of the tube disposed closely adjacent and on opposite sides of the fold line of the tube are clamped between parallel closely adjacent edges of the tubular member defining the longitudinal slot therein, one pair of corresponding terminal end portions of the opposing edges of the tubular member defining the slot being divergent toward the corresponding end of the tubular member to define an inwardly tapering throat for facilitating lengthwise engagement of the tubular member over the folded portion of the collapsible tube.

The main object of this invention is to provide an apparatus by which the remaining portion of fluent material within a collapsible tube thereof may be prevented from being displaced back into a flattened portion of the tube as a non-flattened portion of the tube is squeezed in order to express additional amounts of fluent material therefrom.

Another object of this invention is to provide an apparatus in accordance with the preceding objects and which may be readily constructed of different sizes for use in conjunction with different size collapsible tubes.

A further object of this invention is to provide an apparatus which may be readily utilized effectively even by persons having usage of only one hand.

Yet another object of this invention is to provide an apparatus in accordance with the preceding objects and which will be highly effective in carrying out its intended function.

A final object of this invention to be specifically enumerated herein is to provide an apparatus in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
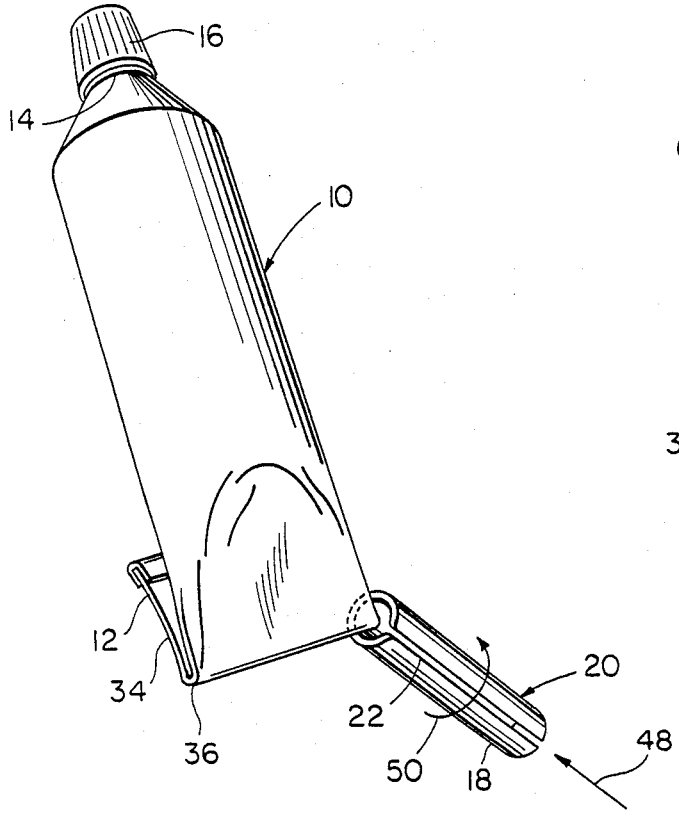
FIG. 1 is a perspective view of a partially flattened collapsible tube with the clip of the instant invention initially engaged with a transverse fold zone of the flattened area of the tube.

Referring now more specifically to the drawings, the numeral 10 generally designates a conventional form of collapsible tube such as that which may be used to contain a fluent material such as tooth paste. The collapsible tube 10 is substantially conventional in design in that it includes a first sealed end 12 and a second end provided with an externally threaded outlet neck 14 having an internally threaded closure cap 16 threadedly engaged therewith.

The clip of the instant invention is referred to in general by the reference numeral 18 and comprises an elongated longitudinally split tubular number or sleeve 20 constructed of stiff, but slightly resilient material. The sleeve 20 defines a longitudinal radial slot 22 therein defined between closely opposing parallel longitudinal edges 24 and 26 of the sleeve 20 and one pair of corresponding ends of the edges 24 and 26 curve divergently away from each other as at 28 and 30 to define an inwardly tapering throat 32 opening into one end of the slot 22.

The tubular member or sleeve 20 may be constructed of any suitable material such as plastic or aluminum as well as other non-corrosive materials.

Figure 2:
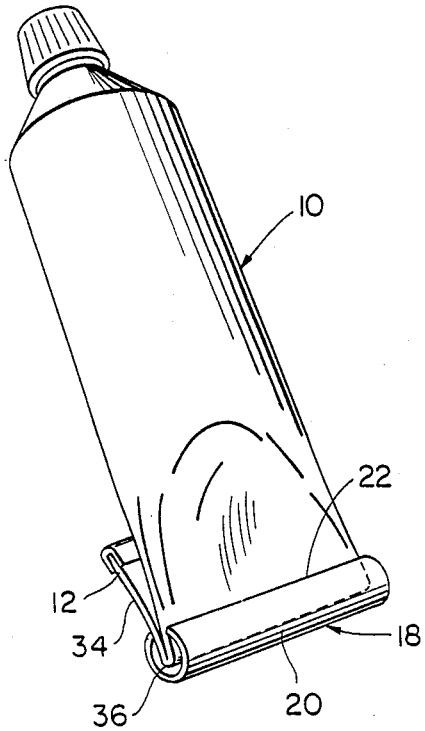
FIG. 2 is a further perspective view similar to FIG. 1, but with the clip fully engaged with the tube to Prevent fluent material within the non-flattened end portion of the collapsible tube returning to the interior of the flattened end portion of the tube as the non-flattened end portion of the tube is squeezed to express additional fluent material therefrom.
Figure 5:
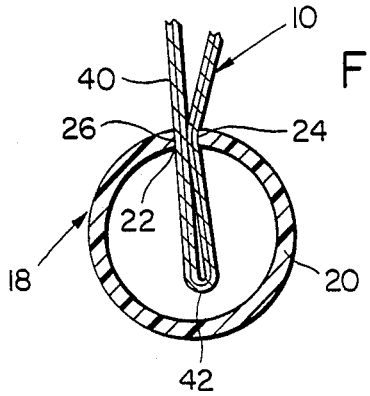
FIG. 5 is an enlarged fragmentary sectional view taken substantially upon the plane indicated by the section line 5—5 of FIG. 4.

In operation, after one end portion of the tube 10 has been collapsed and flattened as at 34 (see FIG. 1) to express material from that end portion of the tube 10, the tube 10 is folded along a transverse fold line 36 back upon itself with the fold line 36 spaced slightly from that portion of the tube 10 which has not had the fluent material expressed therefrom by flattening of the tube. The end of the sleeve 20 defining the throat 32 is registered and engaged with one corner portion of the folded end portion of the tube 10 in the manner illustrated in FIG. 1. Thereafter, the sleeve 20 is pushed, lightly, in the direction of the arrow 48 to wedge the corner portion of the tube 10 into the adjacent sleeve end. This slightly spreads the adjacent end of the slot 22 and the sleeve is rotated one-quarter turn in the direction of arrow 50, whereupon the sleeve 20 will automatically shift to the operative position thereof illustrated in FIG. 2. Those flattened portions of the tube 10 closely adjacent the opposite sides of the fold line 36 are tightly clamped between the edges 24 and 26 thereby preventing fluent material within the tube 10 moving back into the flattened portion of the tube when the unflattened portion of the tube is squeezed in order to express additional fluent material therefrom.

Figure 3:
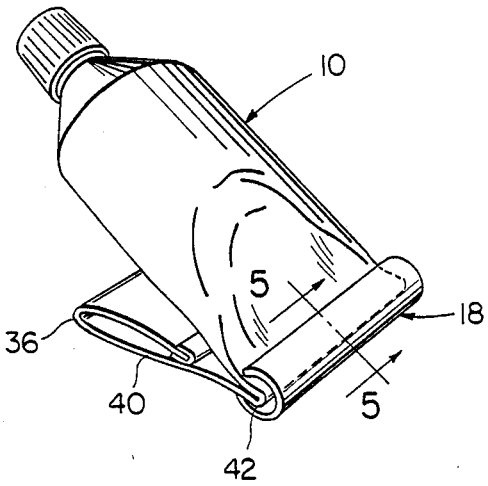
FIG. 3 is a perspective view illustrating the manner in which the flattened end portion of the collapsible tube may be further folded and engaged by the clip of the instant invention subsequent to further expressing of fluent material from the tube.
Figure 4:
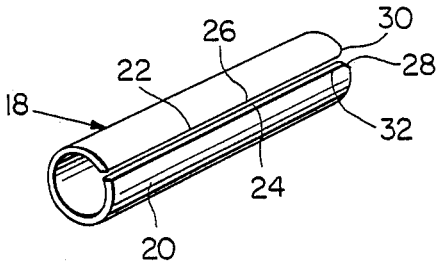
FIG. 4 is an enlarged perspective view of the clip comprising the instant invention.

Subsequent to expressing additional amounts of fluent material from the tube 10, the tube may be further flattened in the area 40 thereof, see FIG. 3, and again folded as at 42, after which the clip 18 may be reinstalled in the manner illustrated in FIG. 3. Of course, this process can be continued until substantially all of the fluent material within the tube 10 has been expressed therefrom.

The return of fluent material to the flattened portion of the tube 10 is prevented by the clamped engagement of the double thickness areas of the flattened and folded portions of the tube 10 being clamped between the edges 24 and 26 and also the fold line 36 of the tube 10 enclosed within the clip 18.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In combination with a collapsible tube for fluent material and of the type including a first end portion equipped with a flattened and sealed terminal end and a second end portion equipped with a fluent material outlet opening, an apparatus for retaining said first end in a flattened condition along transverse zones of said tube progressively spaced therealong from said terminal end toward said outlet end, said apparatus including an elongated tubular clip constructed of stiff, but somewhat resilient material, said clip being of a length greater than the transverse width of said tube along a flattened transverse zone thereof, said clip including a generally radial, full length narrow slot formed therein, said clip being longitudinally split to define closely opposing parallel edges defining the opposite sides of said slot, said tube first end portion being flattened along a flattened zone thereof extending from said terminal end toward said second end portion and being tightly folded back upon itself along a transverse fold line within said zone and closely adjacent the non-flattened second end portion of said tube, said fold line and closely adjacent transverse portions of said zone of said tube on either side of said fold line being received within said clip with said transverse portions being tightly clamped between said parallel edges, the stiffness of said resilient material, and thus said clip, being sufficient to maintain a tight clamping action on said closely adjacent transverse portions of said tube on either side of said fold line sufficient to prevent flow of said fluent material past said fold line from said second end portion of said tube into said first end portion of said tube when said second end portion of said tube is manually squeezed to express said fluent material from said outlet opening.

2. The collapsible tube and clamp combination of claim 1 wherein one pair of corresponding ends of said edges closely adjacent the corresponding end of said clip are divergent toward said clip corresponding end to define an inwardly tapering throat opening inwardly into said slot.

3. The combination of claim 2 wherein said divergent ends of said edges curve oppositely away from each other.

4. The combination of claim 2 wherein said tubular clip is constructed of plastic material.

5. The method of preventing fluent material within a non-flattened discharge end portion of a partially used collapsible tube from returning to the opposite flattened closed end portion of the tube, said method comprising tightly reversely folding said flattened end portion along a fold line closely adjacent said non-flattened end portion and thereafter lengthwise engaging a longitudinally split, and thus slotted, sleeve member constructed of stiff, but slightly resilient material with the folded portion of said tube from one side thereof to a position with said fold line enclosed within said sleeve and the adjacent flattened portions of said tube closely adjacent opposite sides of said fold line being tightly clamped between the opposing edges of said sleeve member defining the longitudinal slot therein, and with the clamping action of said opposing edges on said adjacent flattened portions of said tube on opposite sides of said fold line being sufficient to prevent flow of said fluent material past said fold line from the non-flattened discharge end portion of said tube into said flattened end portion on the other side of said fold line when said non-flattened discharge end portion is manually squeezed to express said fluent material from said discharge end portion.

* * * * *